US005941142A

United States Patent [19]

Janson

[11] Patent Number: 5,941,142

[45] Date of Patent: Aug. 24, 1999

[54] RATCHETING ADJUSTABLE JAW WRENCH AND METHOD OF USE

[76] Inventor: Paul M. Janson, 19151 Tulsa St., Northridge, Calif. 91326-2644

[21] Appl. No.: 08/990,127

[22] Filed: Dec. 12, 1997

[51] Int. Cl.[6] ..... B25B 13/14

[52] U.S. Cl. ..... 81/165; 81/157

[58] Field of Search ..... 81/126, 157, 165

[56] References Cited

U.S. PATENT DOCUMENTS

| | | | |
|---|---|---|---|
| 2,562,060 | 7/1951 | Pehrsson | 81/165 X |
| 2,733,626 | 2/1956 | Mesojedec | 81/165 |
| 3,926,077 | 12/1975 | Nordgren | 81/165 X |
| 5,297,459 | 3/1994 | Stojanowski | 81/165 |

*Primary Examiner*—James G. Smith

*Attorney, Agent, or Firm*—Timothy Thut Tyson; Ted Masters

[57] ABSTRACT

A ratcheting adjustable jaw wrench (20) includes a stationary jaw (36) having a window (42), a movable jaw (46), an adjustment screw (62) which engages the movable jaw (46), and a handle (22). A frame (54) is slidably disposed within the window which carries the adjustment screw. The frame is rotatably connected to the handle so that when the handle is rotated in a reverse direction (70), the frame, adjustment screw, and the movable jaw move away from the stationary jaw allowing the jaws of the wrench to open and ratchet over the flats 501 of the head of a bolt (500).

12 Claims, 11 Drawing Sheets

70
22
76
42
73
75
88
90
85
54
102
501
502
503
38
500
503
508
502
501
506
48

RATCHETING ADJUSTABLE JAW WRENCH AND METHOD OF USE

TECHNICAL FIELD

The present invention relates generally to the field of hand tools, and more particularly to an improved open-end adjustable jaw wrench. When turned in a working direction, the parallel jaws of the wrench firmly grip a pair of opposing flats on a bolt or nut. When the wrench is turned in the opposite reverse direction, the jaws open, thereby allowing the jaws to rotate or ratchet over the corners of the bolt or nut and adopt a gripping position on the next sequential pair of flats.

BACKGROUND ART

Wrenches of innumerable types are well known in the art. One broad category of wrench is the open-end adjustable parallel jaw wrench, sometimes referred to as a "crescent" wrench. This wrench is designed to fit onto a bolt, nut or like fastener from the side, which is in marked contrast to a box-end wrench or a socket, which may only be placed onto the bolt or nut from the top. The open-end adjustable jaw wrench employs an adjustment screw (worn gear) to drive a mating rack which is formed integrally with a movable jaw. By rotating the adjustment screw, the distance between the movable jaw and a parallel stationary jaw may be selectively changed so as to snugly fit the head of the bolt or nut.

Open-end adjustable jaw wrenches have the advantage that they can easily be slipped onto or off of a bolt or nut from the side. However, they also have the disadvantage that when used in congested surroundings, the bolt or nut can only be rotated a fraction of a single turn before the wrench must be removed and repositioned for the next fractional turn. Sockets on the other hand cannot be slipped onto or off of a bolt or nut from the side, however they can be driven by a ratcheting mechanism which allows the bolt or nut to be rotated a desired number of turns without requiring the that the socket be removed and repositioned.

It is therefore readily apparent to those skilled in the art that it would be desirable to combine the ratcheting mechanism operation used to drive sockets with the easily accessible and convenient adjustment features of the open-end adjustable jaw wrench. In fact, the wrench art is replete with suggested methods of effecting this combination. For example, U.S. Pat. No. 5,297,459 illustrates a ratcheting adjustable wrench. The wrench has a worm gear and mating rack adjustable jaw positioning mechanism for placing a pair of jaws which are adjustable with respect to each other so that they may firmly grip various size nuts. A mechanism is responsive to torque applied in a first direction which cause the jaws to tighten and apply torque to a nut, and is also responsive to torque applied in a second direction which allows the jaws to separate and ratchet to a new position. U.S. Pat. No. 4,995,297 shows a locking ratchet wrench. The wrench has a main body with an elongated handle portion and a stationary jaw at one end. A movable jaw with ratchet teeth has its rear end slidably fitted on the main body. A locking pawl block has teeth at the forward end thereof corresponding to the movable jaw ratchet teeth and movable into and out of engagement therewith. A movable handle is pivotally mounted on the main body to move it into and out of toothed engagement with the movable jaw. U.S. Pat. No. 4,913,011 depicts a self-adjusting snap-fit ratchet wrench which has two guided jaws which move linearly against each other along a guided pin, and which are hinged to a handle by pins. The hinges on the jaw to the handle are designed with override leverage wherein the gripping force is increased as the handle is swung in forward stroke, and releases in back stroke to provide a ratcheting action. A return spring exerts force on the jaws for an automatic snapping on the work piece. A locking mechanism may be provided by a fastening means for retaining the guiding pin to hold the jaw opening to a fixed predetermined position.

U.S. Pat. No. 3,955,450 discloses an adjustable wrench for torquing and ratcheting a symmetrical polygon member. The wrench has a body with a fixed jaw and movable jaw. The jaw faces are configured such that an area in each jaw is provided for securely engaging a member to apply torque to the member in either direction, and having an area on the outer end of each jaw such that the polygon member may be ratcheted without removing contact of the wrench from the member. U.S. Pat. No. 3,926,077 comprises a combined adjustable spanner and ratchet wrench. When turned in the working direction, the jaws have a firm grip about the work piece, and when turned in the return direction, the grip about the work piece is released so that the jaws slide thereabout. The wrench comprises a stem which passes through an opening in a tongue embraced by the legs of a fork-like end on the wrench handle, the stem connecting the fork legs and cooperating with the opening to limit the swinging movement of the wrench head and the handle reciprocally. The stem is arranged with the worm in its working position to take a stop position fixed by the edge contour of the opening by bearing on said edge contour. U.S. Pat. No. 3,022,989 constitutes a worm locking means for a slidable side jaw wrench. A latch member selectively holds and releases the slidable jaw so that the wrench is adapted to either turn a nut or move relative thereto at one setting of the wrench. The latch member is selectively engaged by a manually activated leaf spring thereby allowing the jaws to rotate over the corners of the nut resulting in a ratcheting action.

DISCLOSURE OF INVENTION

The present invention is directed to a ratcheting adjustable jaw wrench which bears close similarity to the conventional adjustable jaw wrench, sometimes referred to as a "crescent" wrench. After the jaws of the present invention are adjusted to firmly grip an opposing pair of flats on the head of a bolt or nut, a user rotates the wrench in a working direction to tighten the bolt or nut. The user then rotates the wrench in a reverse direction without having to remove the wrench from the bolt or nut. As the wrench is rotated in the reverse direction, the jaws of the wrench open and rotate or ratchet over the corners of the bolt or nut, and adopt a new gripping position on the next pair of sequential flats. The present invention may be used on any symmetrical convex polygon bolt or nut such as a hexagon, square, or octagon.

The ratcheting action of the present invention is made possible by the addition of a frame which rides within the window (aperture) of the stationary jaw of the wrench. The frame carries the conventional adjustment screw which, in cooperation with a rack portion of the movable jaw, is used to selectively adjust the distance between the jaws. As the handle of the wrench is rotated the reverse direction, the frame pivots around a hinge pin and is moved away from the stationary jaw. Since the movable jaw is connected to the frame by the adjustment screw, the movable jaw also moves away from the stationary jaw, and therefore the jaws of the wrench open. The opening of the jaws allows the wrench to ratchet over opposing corners of the head of the bolt or nut and, when the reverse rotation is stopped, re-grip the next sequential pair of opposing flats.

In accordance with a preferred embodiment of the invention, ratcheting adjustable jaw wrench has a stationary jaw member having a window and a stationary jaw, a movable jaw member having a movable jaw, an adjustment screw, the adjustment screw engaging the movable jaw member, and a handle. A movable frame is disposed within the window, the frame carrying the adjustment screw. The frame is rotatably connected to the handle, so that when the handle is rotated in a reverse direction, the frame, the adjustment screw, and the movable jaw move away from the stationary jaw, thereby opening the jaws of the wrench.

In accordance with an important aspect of the invention, a biasing means continuously urges the movable jaw and the stationary jaw toward one another. The biasing means is overcome when the wrench is rotated in the reverse direction, but moves the jaws toward one another as soon as the reverse rotation ceases.

In accordance with an important feature of the invention, the stationary jaw member further includes a guide slot. A guide pin is disposed within the handle and travels in the guide slot when the handle is rotated in the reverse direction. The cooperating guide pin and guide slot serve to guide and stabilize the movement of the frame within the window.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
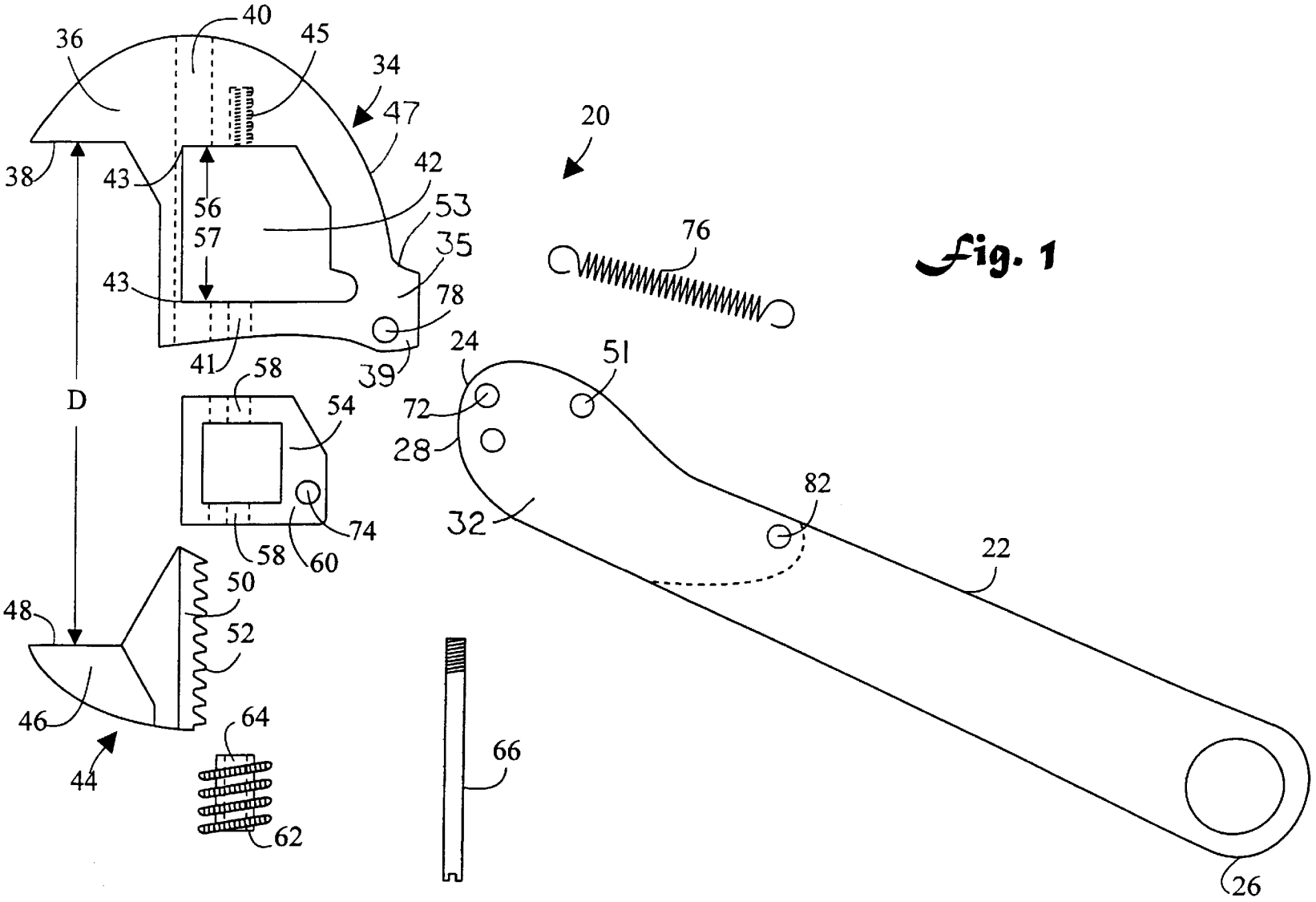
FIG. 1 is an exploded side elevation view of a ratcheting adjustable jaw wrench in accordance with the present invention.

Referring initially to FIG. 1, there is illustrated an exploded side elevation view of a ratcheting adjustable jaw wrench in accordance with the present invention, generally designated as 20. Wrench 20 has an elongated handle 22 having a first end 24 and an opposite second end 26. First end 24 has an opening 28 shown in FIG. 5 defined by first and second forked legs 30 and 32, respectively. In a preferred embodiment, forked legs 30 and 32 are substantially parallel and substantially planar.

Figure 7:
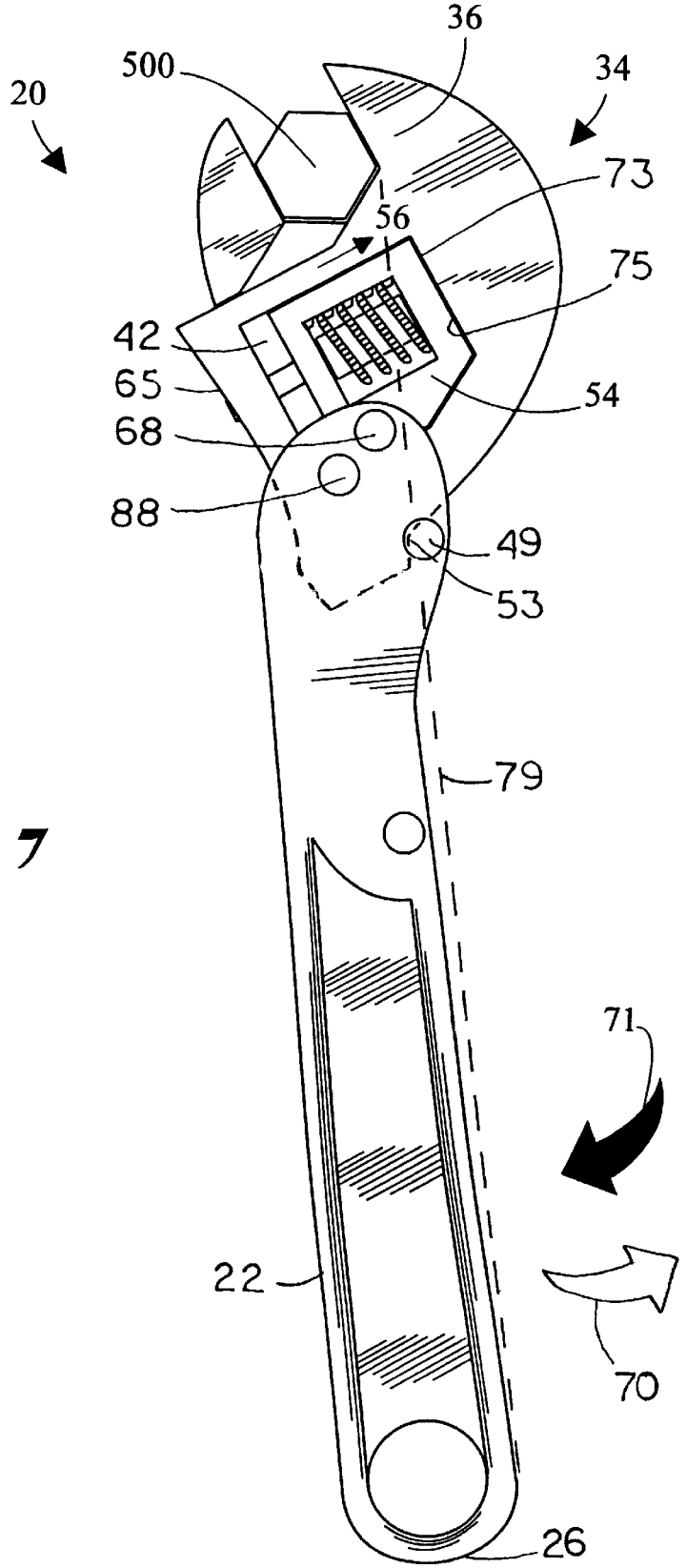
FIG. 7 is a side elevation view of the ratcheting adjustable jaw wrench rotated in a working direction.

A stationary jaw member 34 is shaped and dimensioned to be received by opening 28 in which it slides freely. Stationary jaw member 34 has a stationary jaw 36 which includes a first gripping surface 38, a longitudinal slot 40, and a window 42 extending substantially parallel to longitudinal slot 40. In a preferred embodiment, window 42 has two substantially right angles 43 located adjacent to longitudinal slot 40. Stationary jaw member 34 has a third bore 41 and threaded aperture 45 for receiving a spindle 66. Tongue portion 35 of stationary jaw member 34 is positioned inside opening 28 with right sliding surface 37, shown in FIG. 3, sliding against first forked leg 30 and left sliding surface 39 sliding against second forked leg 32. A rear surface 47 abuts a stop pin 49, shown in FIGS. 3 and 4, which passes through hole 51 in handle 22. A shoulder 53 on rear surface 47 working with stop pin 49 stops stationary jaw member 34 from sliding further when wrench 20 is turning a bolt as shown in FIG. 7.

A movable jaw member 44 has a movable jaw 46 which includes a second gripping surface 48. In a preferred embodiment, first gripping surface 38 and second gripping surface 48 are substantially flat and substantially parallel. Second gripping surface 48 is located a variable distance D from first gripping surface 38. Movable jaw member 44 further includes an integral longitudinal rack 50 having a plurality of teeth 52. Rack 50 is slidable in longitudinal slot 40. A frame 54 is disposed within window 42, and is slidable in directions 56 and 57 which are substantially parallel to longitudinal slot 40. Frame 54 has a first bore 58 oriented substantially parallel to longitudinal slot 40. Frame 54 also has a tongue portion 60 which is shaped and dimensioned to be received by opening 28 in handle 22 shown in FIG. 5.

An adjustment screw 62 is carried by frame 54 and has a second bore 64. Adjustment screw 62 engages teeth 52 of longitudinal rack 50 so that when adjustment screw 62 is selectively rotated, distance D changes. Threaded spindle 66 passes through third bore 41, first bore 58, and second bore 64 and is removably connected to threaded aperture 45. Threaded spindle 66 is oriented substantially parallel to longitudinal slot 40. A hinge pin 68, shown in FIGS. 3 and 4, passes through holes 72 and 74 to rotatably connect tongue portion 60 of frame 54 with first end 24 of handle 22.

A biasing means such as spring 76 urges movable jaw 46 and stationary jaw 36 toward one another. Spring 76 is connected between hole 78 in stationary jaw member 34 and a biasing pin 80, shown in FIGS. 3 and 4, which is inserted in hole 82 in forked legs 30 and 32 of handle 22. Spring 76 is shown in its assemble position in FIG. 9. Spring 76 urges the two jaws together because spring 76 pulls on stationary jaw 36 at hole 78 causing stationary jaw 36 to pivot downward around the pivot point provided by shoulder 53 and stop pin 49 while hinge pin 68 forces movable jaw 46 upward.

Figure 2:
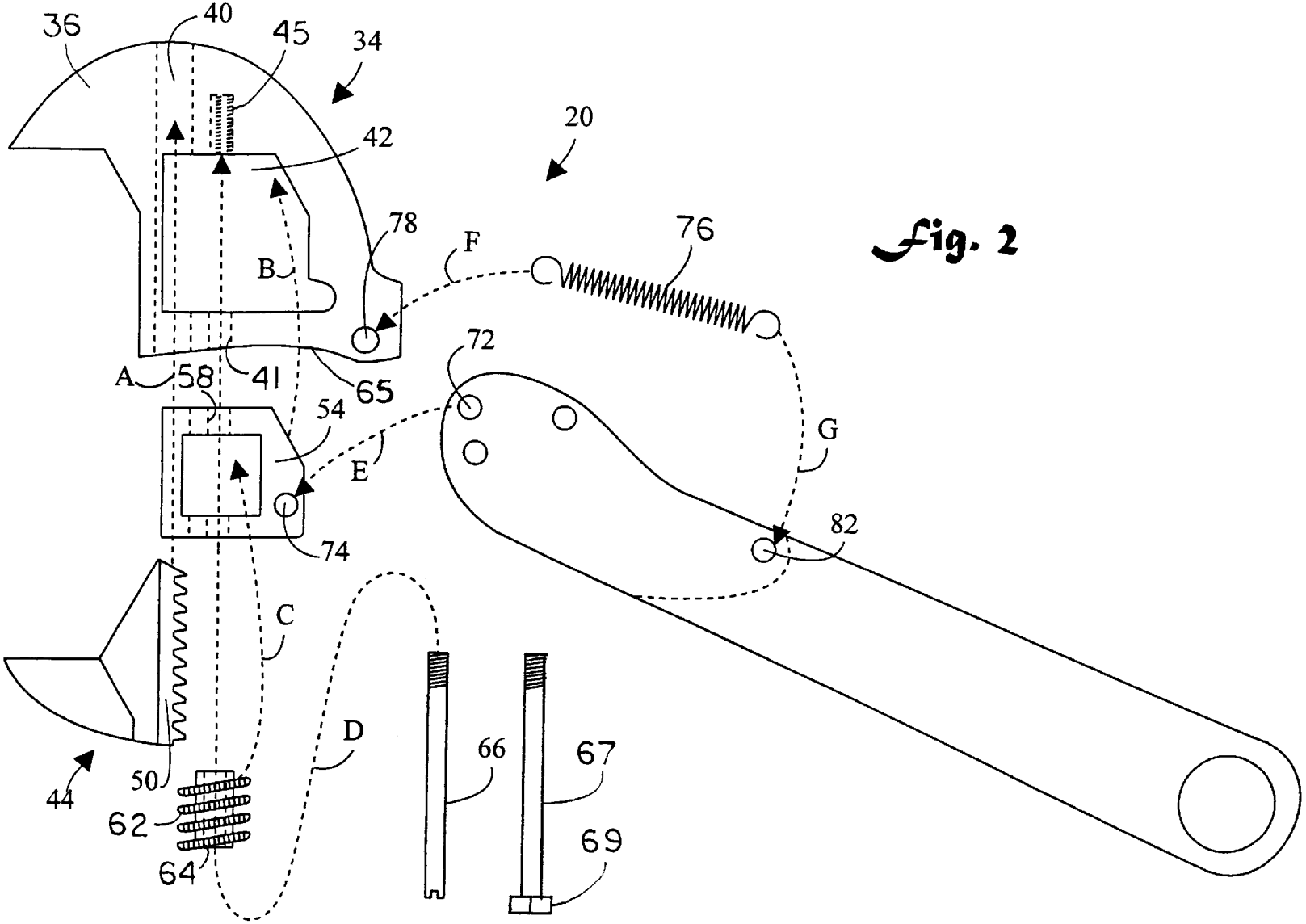
FIG. 2 is an exploded side elevation view of the ratcheting adjustable jaw wrench showing how the elements are connected.

FIG. 2 is an exploded side elevation view of the ratcheting adjustable jaw wrench 20 showing how the elements are connected. Longitudinal rack 50 of movable jaw member 44 slidably engages longitudinal slot 40 of stationary jaw member 34 (dashed line A). Frame 54 is placed in window 42 (dashed line B). Adjustment screw 62 is placed in frame 54 (dashed line C). The jaws, frame, and screw are held together by spindle 66 passing through first bore 41 of fixed jaw 36, second bore 58 of frame 54, third bore 64 of adjustment screw 62, and into threaded aperture 45 of stationary jaw 36 (dashed line D). Rack 50 is retained in place by adjustment screw 62 and slot 40. Hole 72 in handle 22 is aligned with hole 74 in frame 54 and rotatably connected by hinge pin 68 shown in FIGS. 3 and 4 (dashed line). One end of spring 76 is connected to hole 78 in stationary jaw member 34 (dashed line F), and the other end is connected to handle 22 by biasing pin 80 at hole 82 shown in FIG. 3 (dashed line G).

A bolt 67 having a head 69 can be substituted for threaded spindle 66 to provide additional strength across the bottom web 65 of stationary jaw member 34. Head 69 presses against and strengthens the middle of web 65 when it is screwed into threaded aperture 45.

Figure 3:
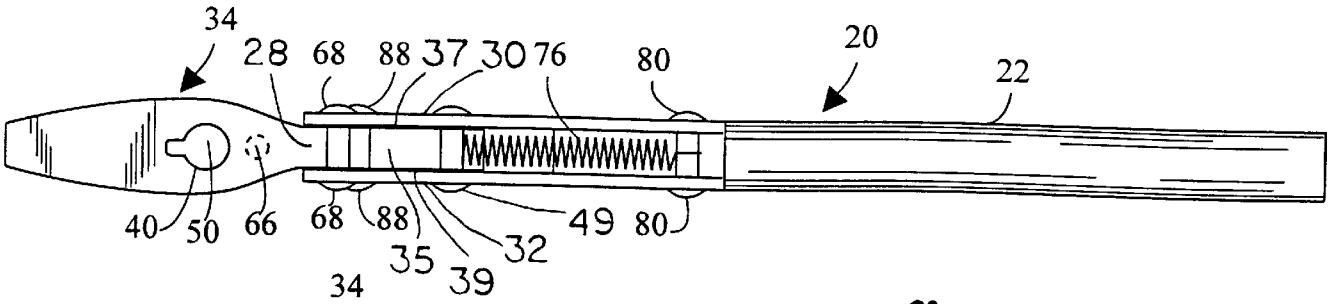
FIG. 3 is a top plan view of the ratcheting adjustable jaw wrench.

FIG. 3 is a top plan view of the ratcheting adjustable jaw wrench 20 showing stationary jaw member 34, longitudinal slot 40, longitudinal rack 50, hinge pin 68, biasing pin 80, stop pin 49, spring 76, and handle 22.

Figure 4:
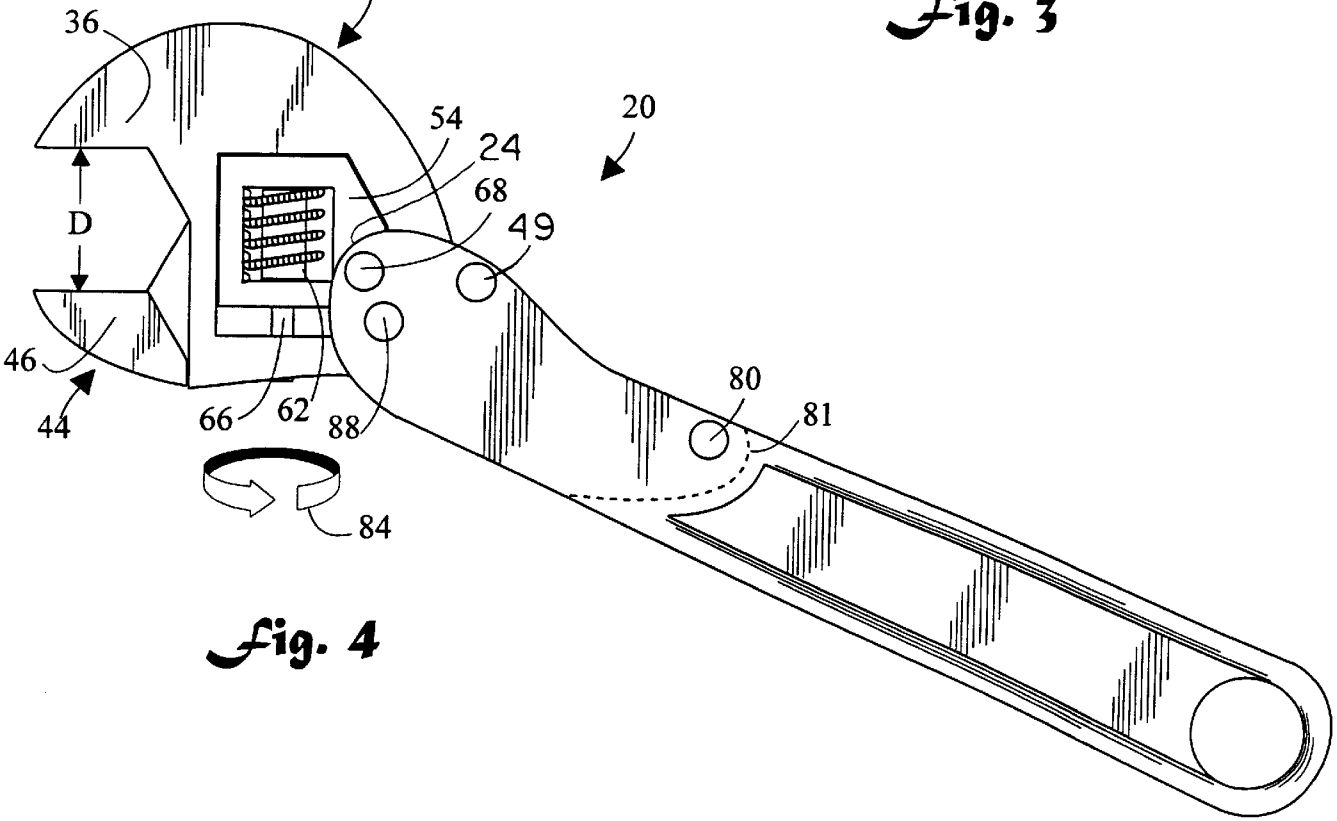
FIG. 4 is a side elevation view of the ratcheting adjustable jaw wrench.

FIG. 4 is a side elevation view of the assembled ratcheting adjustable jaw wrench 20 with stationary and movable jaws 36 and 46 separated by a variable distance D. Adjustment screw 62 has been rotated in a first direction 84 to achieve the desired degree of jaw separation. In a preferred embodiment, handle 22 has an opening 28, shown in FIG. 5, substantially between first end 24 and biasing pin 80, and is solid between biasing pin 80 and second end 26. Line 81 marks the demarcation between the open and solid portions.

Figure 5:
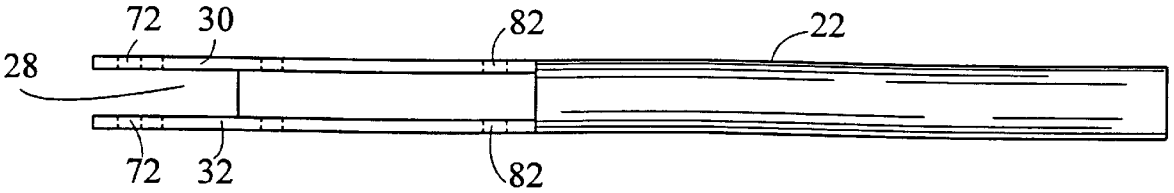
FIG. 5 is a top plan view of a handle.

FIG. 5 is a top plan view of handle 22 showing opening 28, first forked leg 30, second forked leg 32, holes 72, and holes 82.

Figure 6:
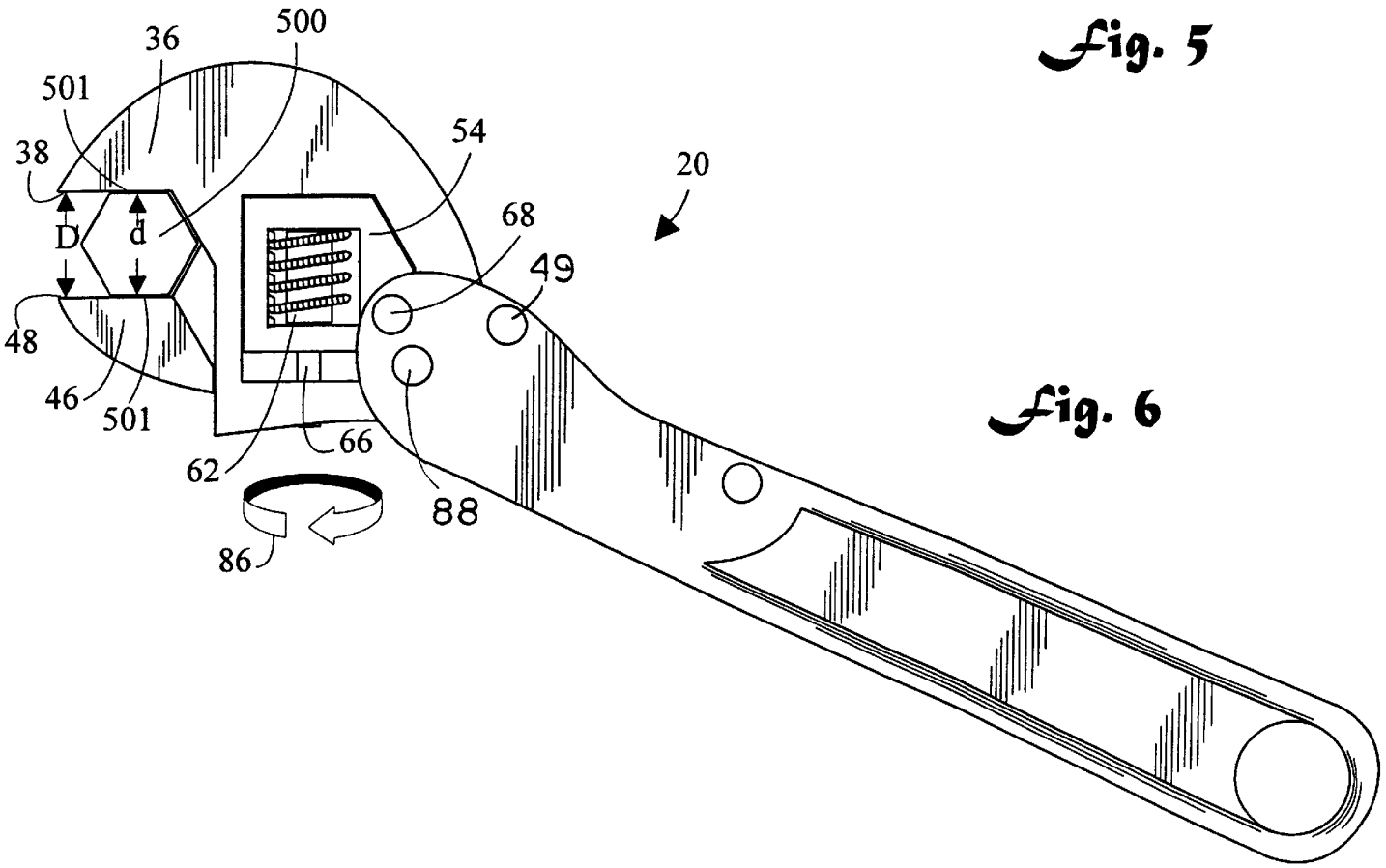
FIG. 6 is a side elevation view of the ratcheting adjustable jaw wrench with the jaws closed around opposing flats of the head of a bolt.

FIG. 6 is a side elevation view of the ratcheting adjustable jaw wrench 20 being adjusted to a bolt 500 having a distance d across its flats. Adjustment screw 62 has been rotated in an opposite second direction 86 until the first and second gripping surfaces 38 and 48 snugly grip the opposing flats 501 of the bolt which are separated by a distance D' less than distance D of FIG. 4 and substantially equal to the distance d between the two opposing flats.

FIG. 7 is a side elevation view of ratcheting adjustable jaw wrench 20 with handle 22 rotated in a working direction 71 approximately 150° from the view in FIG. 6 thereby tightening bolt 500. In the tightening configuration shown in FIG. 7, the top 73 of frame 54 abuts the top 75 of window 42 of stationary jaw member 34 in direction 56, stop pin 49 abuts shoulder 53, and guide pin 88 abuts bottom web 65 forming a rigid tool when torque is applied in working direction 71 for tightening bolt 500.

Figure 7A:
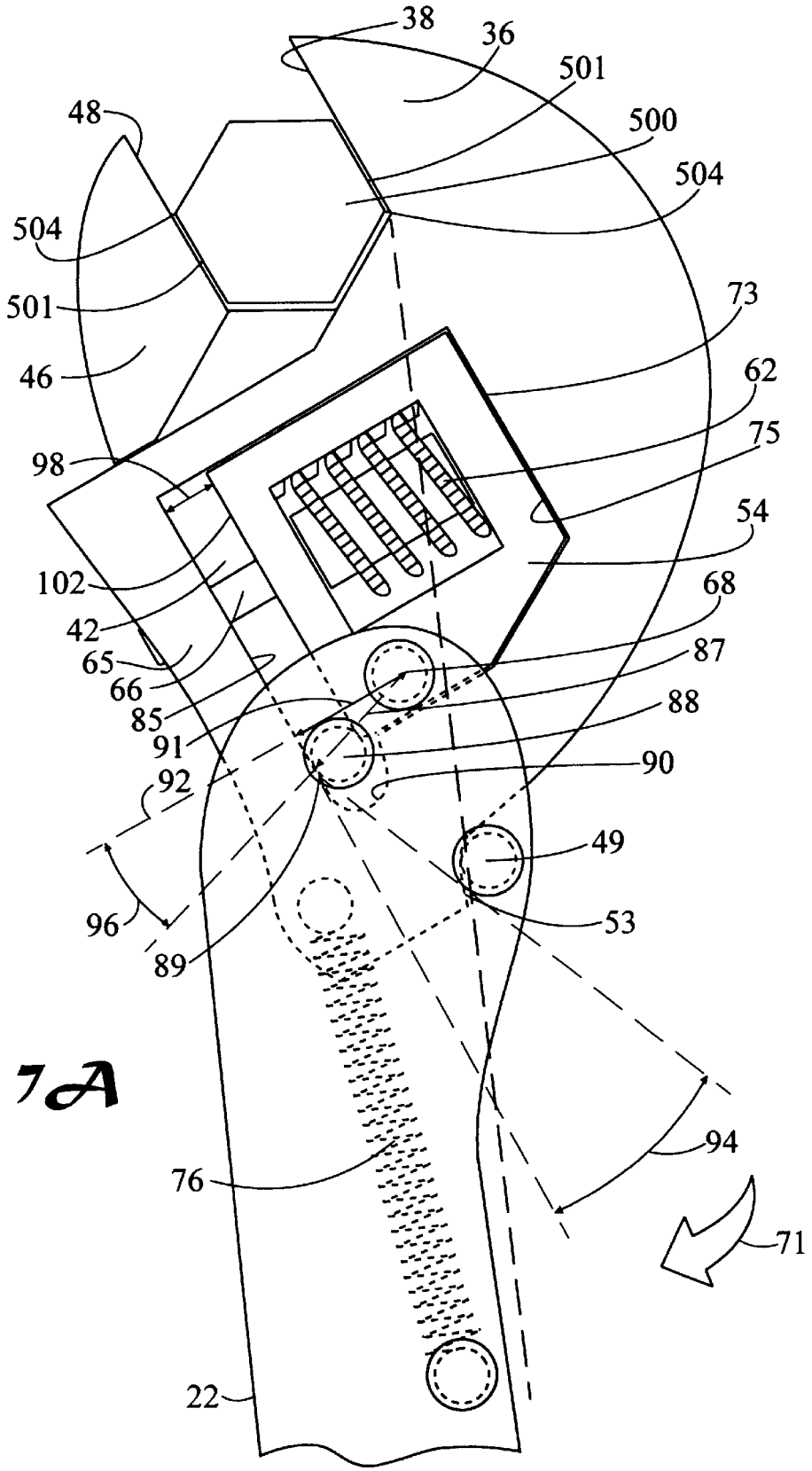
FIG. 7A is an enlarged view of the jaw end of FIG. 7.

FIG. 7A is an enlarged view of the jaw end of FIG. 7 with the internal components added in shadow outline to more clearly show the interrelationships of the various components. Top 73 of frame 54 is against top 75 of window 42 and movable jaw 46 has been adjusted by adjustment screw 62 toward stationary jaw 36 so that first and second gripping surfaces 38 and 48 touch flats 501 of bolt 500. Handle 22 is pushed in direction 71 by the operator while bolt 500 resists causing the handle to rotate around hinge pin 68 until stopped by stop pin 49 butting against shoulder 53 and guide pin 88 butting against the linear bottom 85 of the window 42 at web 65. The radius 87 from hinge pin 68 to bottom of guide pin 88 is equal to the distance from the hinge pin to the bottom at the contact point 89. As handle 22 is rotated about hinge pin 68, guide pin 88 does not touch bottom 85 before point 89 and it cannot be rotated past point 89 because radius 87 is greater than the distance to the bottom after point 89. The distance from guide pin 88 to bottom 85 reaches a minimum at a distance 91 along a line 92 parallel to threaded spindle 66 and perpendicular to linear bottom 85. The angle 96 between the intersection of radius 91 with bottom 85 and minimum distance line 92 is 18°. Angle 96 is selected to provide a shallow angle 94 of 18° for the intersection of guide pin 88 with linear bottom 85. Frame 54 is then rigidly wedged against window top 75 when subjected to the torque of the handle 22. For example, a lever of fifteen millimeters in one embodiment of the wrench 20 between hinge pin 68 and guide pin 88 is subjected to a lever of two hundred thirty millimeters which is the length from hinge pin 68 to second end 26 (FIG. 7) of handle 22 to provide a mechanical advantage of more than fifteen times. Thus, the forces provided by the arrangement of the wrench for holding movable jaw 46 in the position shown are far greater than any countervailing force the operator might create by corners 504 of bolt 500 pushing first and second gripping surfaces 38 and 48 apart. Pins 49 and 88 each support about 50% of the torque provided by the handle 22 on the bolt 500.

Figure 8:
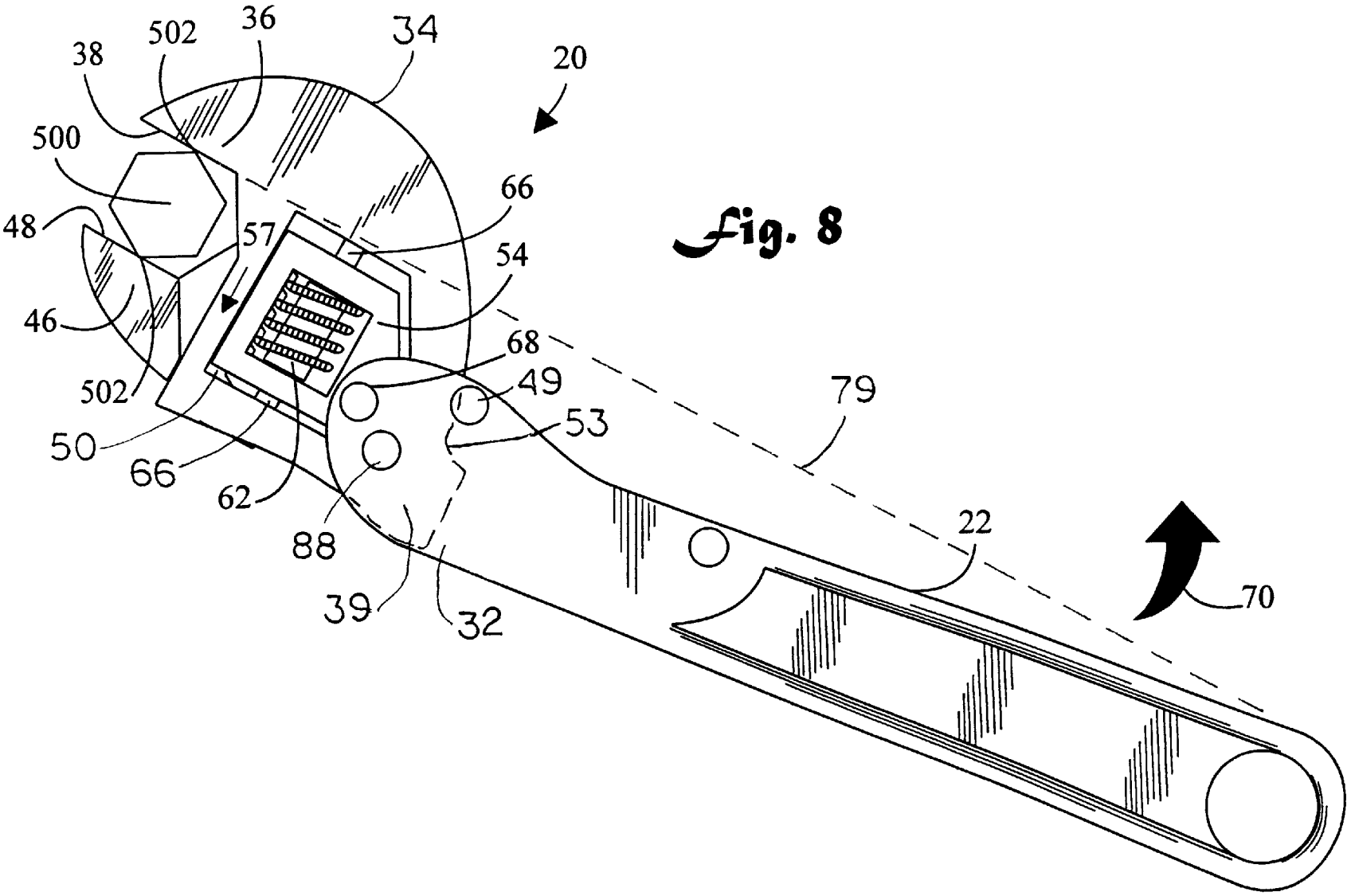
FIG. 8 is a side elevation view of the ratcheting adjustable jaw wrench with the handle rotated in a reverse direction so that the jaws open and rotate around a pair of opposing corners of the head of the bolt.

FIG. 8 is a side elevation view of the ratcheting adjustable jaw wrench 20 with handle 22 rotated approximately 150% in a reverse direction 70 from the view shown in FIG. 7 so that the stationary and movable jaws 36 and 46 respectively open and rotate around a pair of opposing corners 502 of the head of the bolt 500. As handle 22 is rotated in the reverse direction 70, frame 54, adjustment screw 62, and movable jaw 46 pivot about hinge pin 68 and move away from stationary jaw 36 in direction 57, thereby causing first and second gripping surfaces 38 and 48 respectively to move apart and rotate around the pair of corners 502 of bolt 500. Nothing opposes frame 54 from moving down in window 42 to open the jaws except spring 76 shown in FIGS. 8A and 9 which is not strong enough to stop the opening unless bolt 500 is loose. The axis of rotation of the handle 22 is hinge pin 68. Stationary jaw member 34 slides up and down on rack 50 in longitudinal slot 40 (FIG. 3), spindle 66 on adjustment screw 62, and right and left sliding surfaces 37 (FIG. 3) and 39 on first and second forked legs 30 (FIG. 3) and 32. Handle 22 cannot rotate on stationary jaw member 36 because the handle moves in an arc with respect to the stationary jaw member. The handle only rotates with respect to frame 54.

Figure 8A:
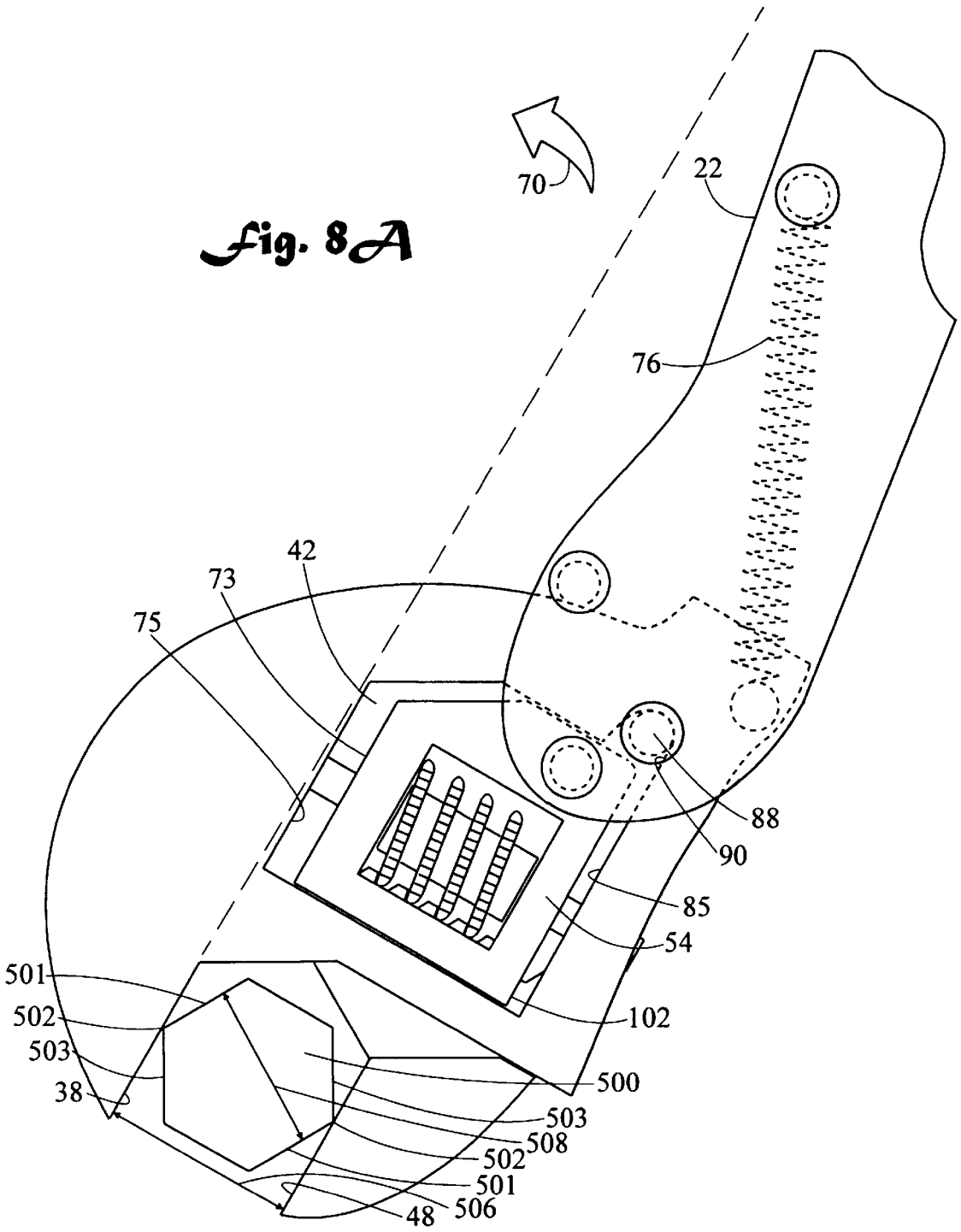
FIG. 8A is an enlarged view of the jaw end of FIG. 8.

FIG. 8A is an enlarged view of the jaw end of FIG. 8 with the internal components added in shadow outline to more clearly show the interrelationships of the various components. As the handle 22 is rotated in the reverse direction 70 to ratchet the first and second gripping surfaces 38 and 48 from flats 501 to flats 503 of bolt 500, the distance between the gripping surfaces must increase from the distance 508 across the flats to the distance 506 across the corners 502. These distances vary with the size of the bolt. In order to accommodate the ratcheting effect, the distance 98 (FIG. 7A) between bottom 102 of frame 54 and bottom 85 of window 42 when frame top 73 is touching window top 75 as shown in FIG. 7A must be equal to or greater than the difference between distances 506 and 508. Frame 54 can then move down enough for first and second gripping surfaces 38 and 48 to pass over corners 502. The bolt capacity of wrench 20 is therefore determined both by the distance D first gripping surface 38 separates from second gripping surface 48 and the distance 98 between the bottom 102 of the frame and bottom 85 of the window when the frame is in the up position of FIG. 7A.

Figure 9:
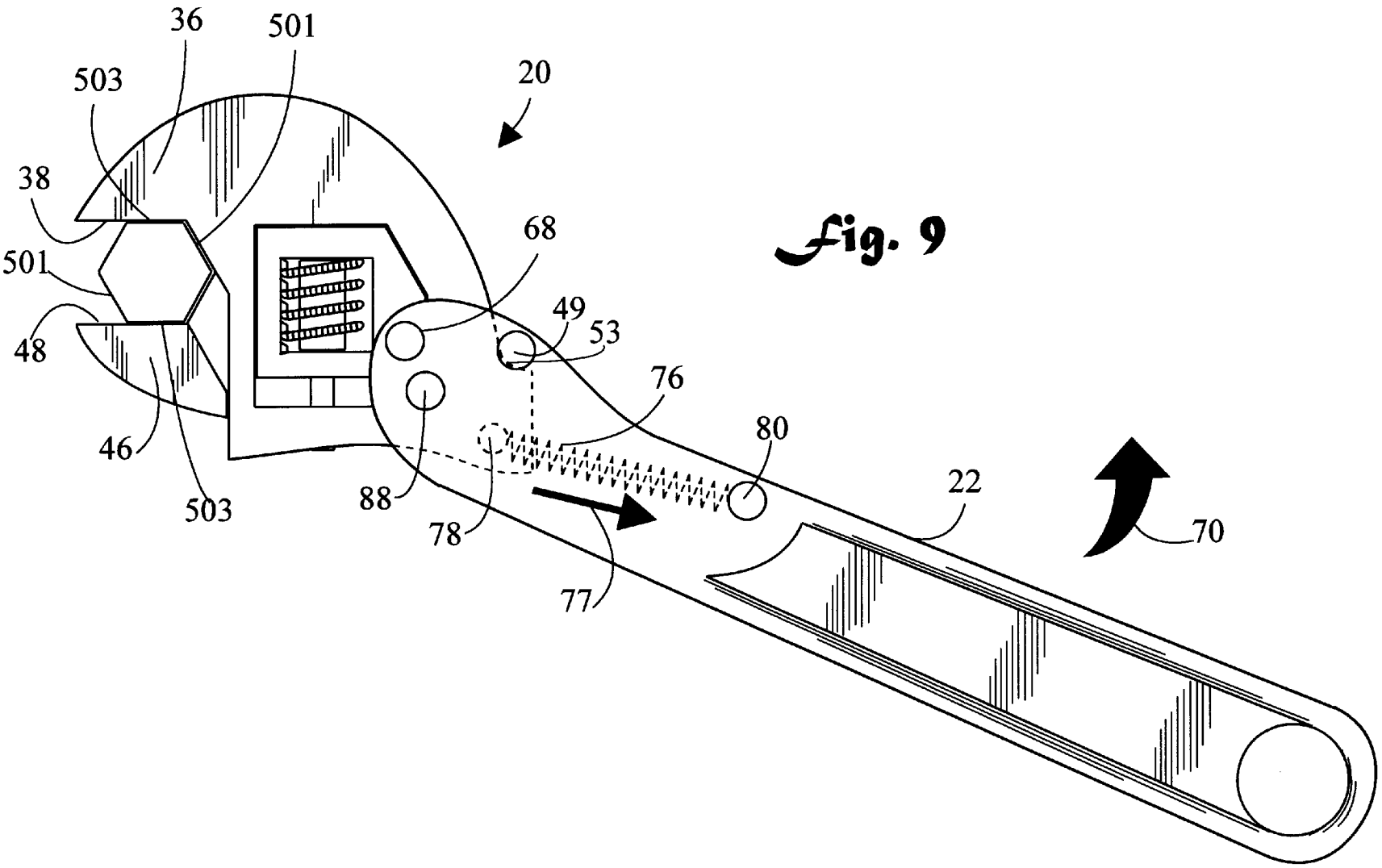
FIG. 9 is a side elevation view of the ratcheting adjustable jaw wrench with the jaws griping the next sequential pair of opposing flats of the bolt.

FIG. 9 is a side elevation view of the ratcheting adjustable jaw wrench 20 with jaws 36 and 46 gripping the next sequential pair of opposing flats of bolt 500. Handle 22 is rotated in direction 70 until gripping surfaces 38 and 48 align with the next sequential pair of flats 503 of bolt 500. When the reverse rotation is stopped, the biasing means provided by spring 76 then urges movable jaw 46 and stationary jaw 36 toward one another to re-grip the bolt 500. Spring 76 applies a force in direction 77 which results in a moment about hinge pin 68. The process of tightening the bolt 500 in working direction 71 and ratcheting in reverse direction 70 is then repeated until the bolt 500 is tightened.

Figure 10:
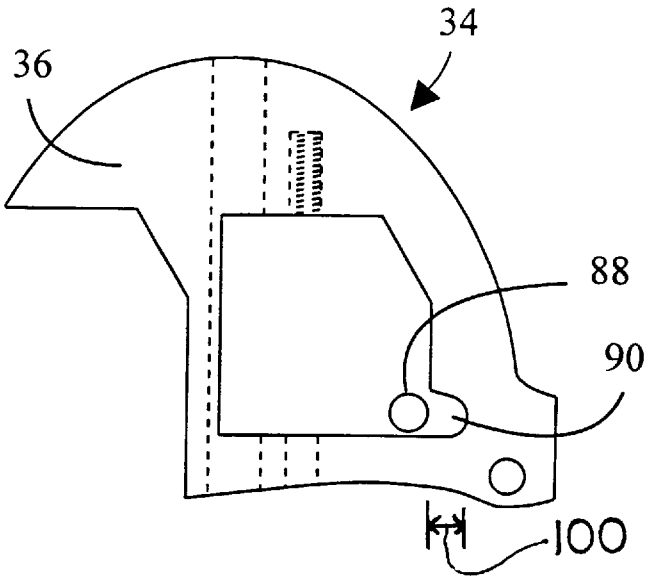
FIG. 10 is a side elevation view of a stationary jaw member and a guide pin.
Figure 11:
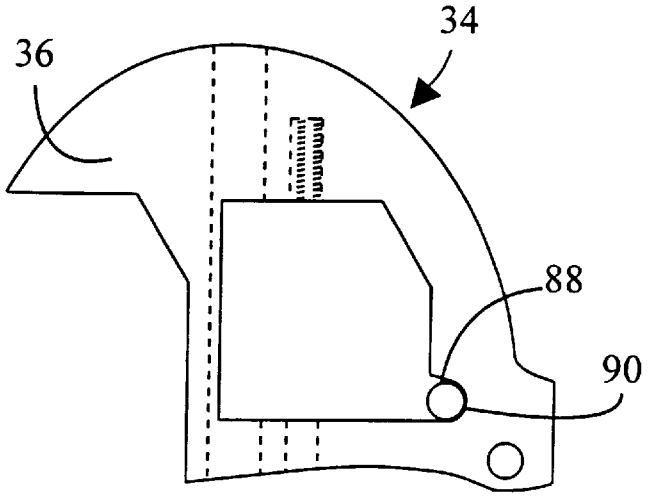
FIG. 11 is a side elevation view of the stationary jaw member with the guide pin moved into a guide slot.

FIGS. 10 and 11 are side elevation views of stationary jaw member 34 and guide pin 88 (refer also to FIGS. 3, 4, 7A, and 8A). Guide pin 88 is disposed between first and second forked legs 30 and 32 respectively (FIG. 5). Stationary jaw member has a guide slot 90. When stationary jaw 36 and movable jaw 46 are urged toward one another by spring 76, guide pin 88 resides slightly outside guide slot 90 (FIG. 10). This is the position of guide pin 88 as shown in FIGS. 4, 6, 7, 7A, and 9. When handle 22 is moved in reverse direction 70 (refer to FIGS. 8 and 8A), guide pin 88 travels into guide slot 90 and causes movable jaw member 34, frame 54, and adjustment screw 62 to move downward in a smooth controlled manner away from stationary jaw 36. This is the position of guide pin 88 as shown in FIG. 8. The depth 100 of guide slot 90 is determined by the size of the bolt in the same manner as the distance 98 from the bottom of the frame to the bottom of the window discussed in conjunction with FIG. 8A. In order to clear the shoulders of a bolt, guide pin 88 arcs distance 100 into guide slot 90 slightly more than the distance 98.

Ratcheting of the wrench is easily achieved when a nut or bolt is tight. Ratcheting does not occur when the nut or bolt is loose because there is no resistance to the rotation which pushes the jaws open against the countervailing force of spring 76 which holds the jaws closed. The mechanic them removes the wrench from the nut or bolt and turns it with his fingers.

A condition often arises where the nut or bolt is not tight enough to cause the wrench to ratchet but yet the nut or bolt still cannot be turned with the fingers. Alternatively, the nut or bolt may be impossible to turn through part of a complete circle by the fingers alone but is entirely loose during another part. The mechanic must then repeatedly place the wrench on and take it off of the nut or bolt as he turns it.

Because of the angular relationships of the various components of wrench 20 as shown in FIG. 7, it appears to be possible to enhance the ratcheting effect of the wrench by the way it is turned. If a line 79 is drawn from the top of handle 22 near second end 26 to the top of bolt 500, the line passes above pivot pin 68. This means that when a mechanic wants the ratcheting effect shown in FIG. 8 and pushes on handle 22 toward bolt 500 while simultaneously turning second end 26 in direction 70 and slightly urging first end 24 in direction 71, the action appears to push pivot pin 68 further away from line 79 thereby helping to force open the jaws. This action allows the wrench to ratchet in some situations where the resistance to turning by the bolt itself is less than adequate to overcome the bias of spring 76 (FIG. 9).

Figure 12:
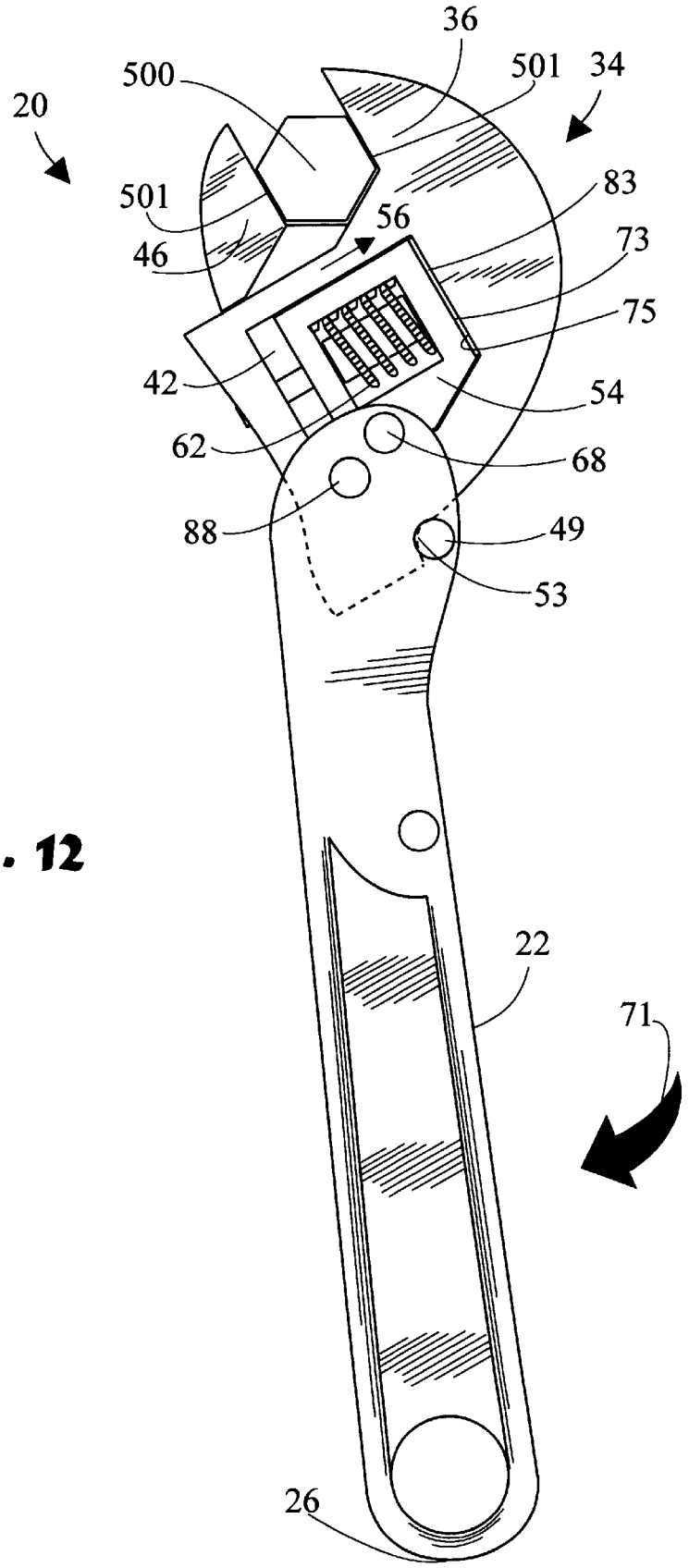
FIG. 12 is a side elevation view of the ratcheting adjustable jaw wrench with the frame spaced from the top of the window.

FIG. 12 is a side elevation view of the ratcheting adjustable jaw wrench 20 with top 73 of frame 54 spaced from top 75 of window 42. In this configuration, wrench 20 appears to convert some of the torque applied to handle 22 when it is moved in working direction 71 to pressing jaws 36 and 36 against flats 501 of bolt 500. The pressing force appears to be greater than the pressing force that can be achieved by the turning of adjustment screw 62 alone. The wrench is first adjusted as shown in FIG. 7 with no space remaining between the frame and the top of the window making the wrench rigid when turned in working direction 71. Adjustment screw 62 is then backed off a little creating a space 83 between the top of the frame and the top of the window. Then when handle 22 is turned in working direction 71, handle 22 appears to pivot slightly around stop pin 49 on shoulder 53 forcing hinge pin 68 and movable jaw 46 upward to press on flats 501 of bolt 500. Considerable leverage is created on pin 68 by handle 22 rotating about stop pin 49 because the length of the lever from stop pin 49 to second end 26 is approximately nine times the length of the lever from stop pin 49 to hinge pin 68. The more torque the mechanic applies to second end 26, the more pressure is applied to hinge pin 68 causing movable jaw 46 to press with more force against the flats 501 of bolt 500.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A ratcheting adjustable jaw wrench, comprising:

an elongated handle having a first end and an opposite second end, said first end having an opening defined by first and second forked legs;

a stationary jaw member having a stationary jaw which includes a first gripping surface, a longitudinal slot, and a window extending substantially parallel to said longitudinal slot;

a movable jaw member having a movable jaw which includes a second gripping surface, said second gripping surface located a variable distance D from said first gripping surface, said movable jaw member further including an integral longitudinal rack having a plurality of teeth, said rack slidable in said longitudinal slot;

a frame disposed within said window, said frame slidable in a direction substantially parallel to said longitudinal slot, said frame having a first bore oriented substantially parallel to said longitudinal slot, said frame having a tongue portion received by said opening in said handle;

an adjustment screw carried by said frame, said adjustment screw having a second bore, said adjustment screw engaging said teeth of said longitudinal rack so that when said adjustment screw is selectively rotated said distance D changes;

a spindle passing through said first and second bores, said spindle oriented substantially parallel to said longitudinal slot, said spindle connected to said stationary jaw member;

a hinge pin rotatably connecting said tongue portion of said frame with said first end of said handle, so that when said handle is rotated in a reverse direction, said frame and said movable jaw move away from said stationary jaw; and, a biasing means for urging said movable jaw and said stationary jaw toward one another.

2. A ratcheting adjustable jaw wrench according to claim 1, wherein said biasing means includes a spring connected between said handle and said stationary jaw member.

3. A ratcheting adjustable jaw wrench according to claim 1, further including:

said stationary jaw member further including a guide slot; and, a guide pin disposed between said first and second forked legs, said guide pin traveling in said guide slot when said handle is rotated in said reverse direction.

4. A ratcheting adjustable jaw wrench according to claim 1, said first and second forked legs being substantially parallel.

5. A ratcheting adjustable jaw wrench according to claim 4, said first and second forked legs being substantially planar.

6. A ratcheting adjustable jaw wrench according to claim 1, said window having two substantially right angles.

7. A ratcheting adjustable jaw wrench according to claim 1, wherein said first gripping surface and said second gripping surface are substantially parallel.

8. A ratcheting adjustable jaw wrench according to claim 7, wherein said first and second gripping surfaces are substantially flat.

9. An improved adjustable jaw wrench, the adjustable jaw wrench having a stationary jaw member having a window and a stationary jaw, a movable jaw member having a movable jaw, an adjustment screw, said adjustment screw engaging said movable jaw member, and a handle; the improvement comprising:

a frame disposed within said window, said frame carrying said adjustment screw; and, said frame rotatably connected to said handle, so that when said handle is rotated in a reverse direction, said frame, said adjustment screw, and said movable jaw move away from said stationary jaw.

10. A ratcheting adjustable jaw wrench according to claim 9, said wrench further including a biasing means for urging said movable jaw and said stationary jaw toward one another.

11. A ratcheting adjustable jaw wrench according to claim 10, wherein said biasing means includes a spring connected between said handle and said stationary jaw member.

12. A ratcheting adjustable jaw wrench according to claim 9, further including:

said stationary jaw member further including a guide slot;

said handle further including first and second forked legs; and, a guide pin disposed between said first and second forked legs, said guide pin traveling in said guide slot when said handle is rotated in said reverse direction.

* * * * *